US009383153B2

(12) United States Patent
Nebeker et al.

(10) Patent No.: US 9,383,153 B2
(45) Date of Patent: Jul. 5, 2016

(54) FIRE CONTROL SYSTEM FOR FIREARMS

(71) Applicant: Sturm, Ruger & Company, Inc., Southport, CT (US)

(72) Inventors: Darin Nebeker, Gilbert, AZ (US); Joseph J. Zajk, Prescott, AZ (US); Sam Vavro, Dacono, CO (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/684,932

(22) Filed: Apr. 13, 2015

(65) Prior Publication Data

US 2015/0292828 A1 Oct. 15, 2015

Related U.S. Application Data

(60) Provisional application No. 61/978,605, filed on Apr. 11, 2014.

(51) Int. Cl.

| | |
|---|---|
| ***F41A 17/56*** | (2006.01) |
| ***F41A 19/29*** | (2006.01) |
| ***F41A 17/46*** | (2006.01) |
| *F41A 19/10* | (2006.01) |
| *F41A 19/12* | (2006.01) |
| *F41A 17/72* | (2006.01) |

(52) U.S. Cl.
CPC ..... *F41A 17/56* (2013.01); *F41A 17/46* (2013.01); *F41A 19/29* (2013.01); *F41A 17/72* (2013.01); *F41A 19/10* (2013.01); *F41A 19/12* (2013.01)

(58) Field of Classification Search
CPC ..... F41A 17/56–17/58; F41A 17/64–17/66
USPC ..... 42/69.02, 70.04–70.06
See application file for complete search history.

(56) References Cited

U.S. PATENT DOCUMENTS

| | | | | |
|---|---|---|---|---|
| 4,203,348 | A * | 5/1980 | Sokolovsky | F41A 17/38 42/70.04 |
| 4,313,274 | A * | 2/1982 | Ludwig | F41A 17/72 42/70.08 |
| 4,575,963 | A | 3/1986 | Ruger et al. | |
| 4,590,697 | A * | 5/1986 | Ruger | F41A 17/56 42/70.01 |
| 5,157,209 | A | 10/1992 | Dunn | |
| 5,426,881 | A * | 6/1995 | Ruger | F41A 17/74 42/70.08 |
| 5,625,971 | A * | 5/1997 | Tuma | F41A 17/24 42/70.01 |
| 6,256,918 | B1 * | 7/2001 | Szabo | F41A 17/72 42/69.03 |
| 6,843,013 | B2 * | 1/2005 | Cutini | F41A 17/46 42/70.01 |
| 7,194,833 | B1 * | 3/2007 | Curry | F41A 19/12 42/14 |
| 7,472,507 | B2 * | 1/2009 | Curry | F41A 19/15 42/14 |
| 7,703,230 | B2 | 4/2010 | Curry et al. | |
| 8,132,496 | B2 | 3/2012 | Zukowski | |
| 8,250,799 | B2 | 8/2012 | Duperry et al. | |
| 8,555,539 | B2 | 10/2013 | Pflaumer et al. | |
| 2015/0068092 | A1 * | 3/2015 | Kallio | F41A 17/72 42/70.08 |

OTHER PUBLICATIONS

Corresponding International Search Report and Written Opinion for PCT/US15/25536 dated Aug. 12, 2015.

* cited by examiner

*Primary Examiner* — Troy Chambers
*Assistant Examiner* — Joshua Semick
(74) *Attorney, Agent, or Firm* — The Belles Group, P.C.

(57) ABSTRACT

A striker-fired firearm in one embodiment includes a trigger assembly including a trigger and trigger bar supported by a frame, a rotatable sear operable to hold a spring-biased striker in a cocked ready-to-fire position, and a rotatable sear blocker operable to prevent rotation of the sear. The trigger bar is operably linked to the sear and blocker such that pulling the trigger rotates the sear and blocker. When the blocker is in a blocking position, the blocker engages and prevents movement of the sear and release of the striker in the absence of a trigger pull. When the blocker is in a non-blocking position effectuated by pulling the trigger, the blocker disengages the sear which rotates and releases the striker to fire the firearm.

20 Claims, 12 Drawing Sheets

FIRE CONTROL SYSTEM FOR FIREARMS

CROSS-REFERENCE TO RELATED APPLICATIONS

The present application claims the benefit of U.S. Provisional Application No. 61/978,605 filed on Apr. 11, 2014, which is incorporated herein by reference in its entirety.

BACKGROUND

The present invention generally relates to firearms, and more particularly to fire control systems with safety mechanisms suitable for auto-loading pistols.

Firearms such as semiautomatic auto-loading pistols come in a variety of full size and compact platforms for concealed carry applications. One type of firing mechanism found in pistols utilizes a pivotable spring-biased hammer which is held in a rear cocked and ready-to-fire position. To discharge the pistol, the hammer is released from a cocked position via a trigger pull which impacts and drives a firing pin forward to contact and detonate a chambered ammunition cartridge. Alternatively, "striker-fired" pistols have a somewhat more simplified firing mechanism which utilize a linearly movable spring-biased striker that is held in a cocked position. Pulling the trigger releases the striker to directly contact and detonate a chambered ammunition round.

A firing blocker mechanism intended to prevent discharge of a pistol or other type firearm in the absence of an intentional trigger pull is desired.

SUMMARY

A firearm with firing blocker mechanism is provided and configured to disable firing of a firearm in the absence of an intentional trigger pull. In one embodiment, the firearm may be a semiautomatic auto-loading pistol.

In one embodiment, a firearm with striker firing mechanism includes: a longitudinal axis; a frame; a reciprocating slide disposed on the frame; a barrel disposed at least partially in the slide and defining a chamber for holding a cartridge; a spring-biased striker movable in a linear path between a rearward cocked position and forward firing position for striking a chambered cartridge, the striker including a catch protrusion; a trigger mechanism including a trigger bar coupled to a trigger movably disposed in the frame, the trigger bar movable in rearward and forward axial directions via operation of the trigger; a sear rotatably disposed in the frame and operably linked to the trigger bar, the sear movable via operation of the trigger to selectively engage the catch protrusion to hold the striker in the rearward cocked position and to disengage the catch protrusion to release the striker for striking the chambered cartridge; and a blocker rotatably disposed in the frame and operably linked to the trigger bar, the blocker movable into and out of engagement with the sear via operation of the trigger; wherein the blocker is rotatable between a blocking position engaged with the sear which prevents movement of the sear to release the striker from the rearward cocked position and a non-blocking position disengaged from the sear which is then movable to release the striker for firing the firearm.

In one embodiment, a pistol with striker firing mechanism includes: a longitudinal axis; a frame; a reciprocating slide disposed on the frame; a barrel disposed at least partially in the slide and defining a chamber for holding a cartridge; a spring-biased striker movable in a linear path between a rearward cocked position and forward firing position for striking a chambered cartridge, the striker including a sear notch; a trigger assembly including a trigger bar coupled to a trigger movably disposed in the frame, the trigger bar movable in rearward and forward axial directions via operation of the trigger; a sear rotatably disposed in the frame and operably linked to the trigger bar, the sear movable via operation of the trigger to selectively engage the sear notch to hold the striker in the rearward cocked position and to disengage the sear notch to release the striker for striking the chambered cartridge; and a blocker rotatably disposed in the frame and operably linked to the trigger bar, the blocker having a blocking surface movable into and out of engagement with the sear via operation of the trigger; wherein the blocker is movable to a first rotational blocking position that arrests movement of the sear and a second rotational non-blocking position that enables rotation of the sear to fire the pistol.

A method for firing the foregoing embodiment of the pistol includes: engaging the sear with the sear notch of the striker to hold the sear in the rearward cocked position; positioning the blocker in the blocking position; pulling the trigger; rotating the blocker to the non-blocking position; rotating the sear to disengage the sear from the sear notch; and moving the striker to the forward firing position to discharge the pistol.

In one embodiment, a firearm with striker firing mechanism includes: a longitudinal axis; a frame; a reciprocating slide disposed on the frame; a barrel disposed at least partially in the slide and defining a chamber for holding a cartridge; a spring-biased striker movable in a linear path between a rearward cocked position and forward firing position for striking a chambered cartridge, the striker including a sear notch; a trigger assembly including a trigger bar coupled to a trigger movably disposed in the frame, the trigger bar movable in rearward and forward axial directions via operation of the trigger; a sear rotatably disposed in the frame and operably linked to a first notch in the trigger bar, the sear engaged with the striker and movable via operation of the trigger to disengage and release the striker for movement to the firing position; and a blocker rotatably disposed in the frame and operably linked to a second notch in the trigger bar, the blocker having a blocking surface movable into and out of engagement with the sear via operation of the trigger; wherein the blocker is movable to a first rotational blocking position that arrests movement of the sear and a second rotational non-blocking position that enables rotation of the sear to fire the pistol.

BRIEF DESCRIPTION OF THE DRAWINGS

The features of the exemplary embodiments will be described with reference to the following drawings where like elements are labeled similarly, and in which.

Figure 1:
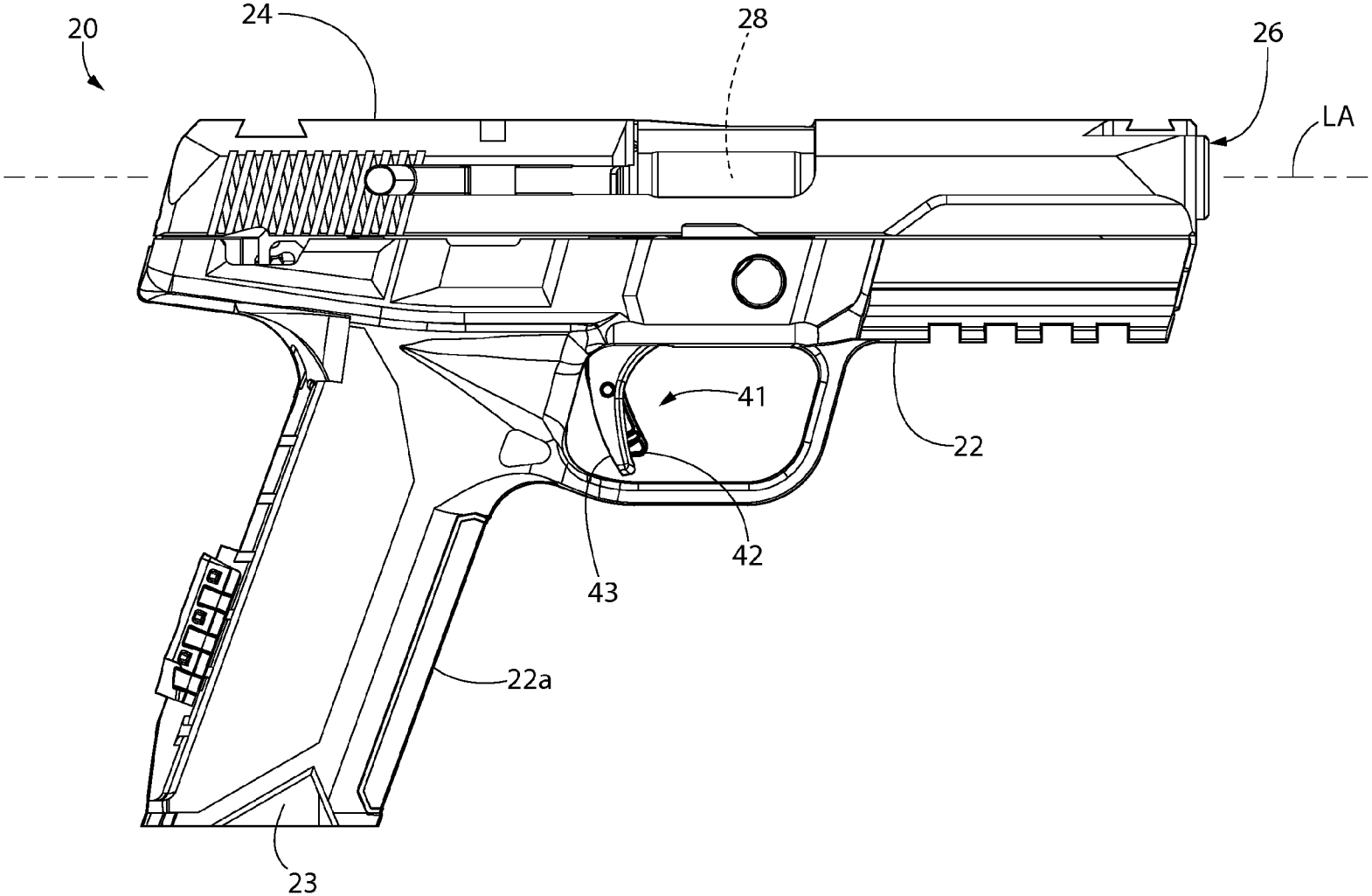
FIG. 1 is a right side elevation view of one exemplary embodiment of a firearm in the form of a pistol including a firing control system with firing blocker mechanism according to the present disclosure.

All drawings are schematic and not necessarily to scale.

DETAILED DESCRIPTION

Exemplary embodiments of the present invention provide an auto-loading firearm with firing blocker mechanism and related method of operation. In one embodiment, the firearm may be a pistol; however, the mechanism may be used with other types of firearms including long guns (e.g. rifles and shotguns).

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
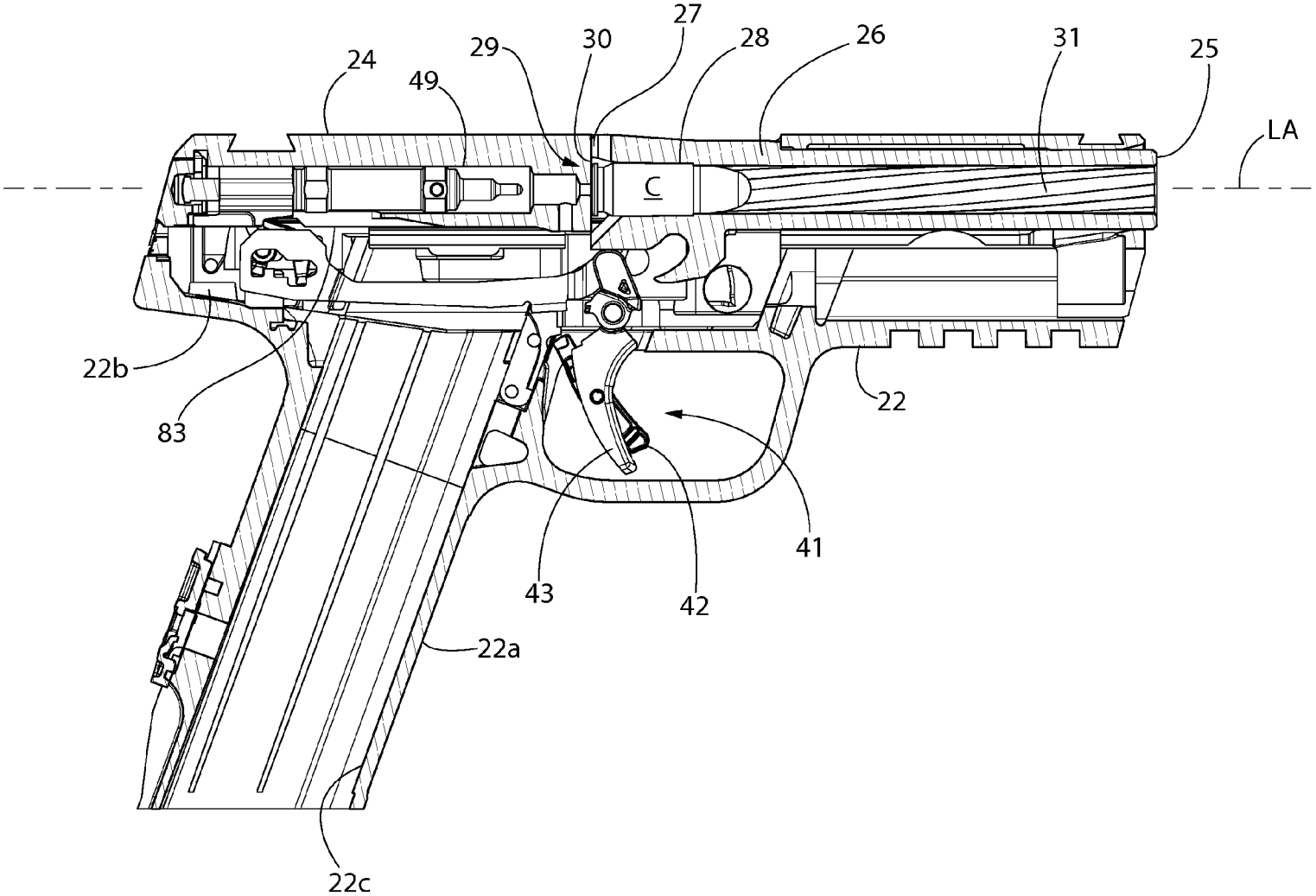
FIG. 2 is a right side cross-sectional elevation view of the firearm of FIG. 1.

FIGS. 1 and 2 are right side elevation and cross-sectional views respectively of a pistol 20 including a firing blocker mechanism according to the present disclosure. Pistol 20 includes a grip frame 22, slide 24 movably mounted thereon, and barrel 26. Frame 22 includes a rear downwardly extending grip portion 22*a* for grasping and a longitudinally-extending cavity 22*b* which opens upwards and receives fire control housing insert 80 therein. Fire control housing insert 80 supports various firing control mechanism components which advantageously may be mounted therein prior to inserting the insert into the frame 22 to facilitate assembly of the pistol. Accordingly, the fire control housing insert 80 with firing control mechanism components is mountable in frame 22 as a unit. Advantageously, this allows the fire control components to be pre-mounted in the insert 80 in a simplified and readily more accessible manner rather than mounting the components individually in the frame. In other embodiments, the firing control mechanism components however may be directly mounted in frame 22 without use of an insert 80. The invention is therefore expressly not limited to either arrangement.

Slide 24 is slidably mounted on pistol 20, and in one embodiment on fire control housing insert 80 via a support rails 21 (see FIG. 7) on the insert and mating grooves on the slide (not shown) for axial reciprocating movement forwards and rearwards thereon. Such arrangements are well known and understood by those in the art without further elaboration. Alternatively, slide 24 may be mounted directly on frame 22 for reciprocating motion. A recoil spring (not shown) operably associated with slide 24 acts to return the slide to the forward position shown in FIG. 1 after discharging pistol 20.

Grip portion 22*a* of frame 22 defines a downwardly open magazine cavity 22*c* which receives and supports therein an ammunition magazine 23. Magazine 23 may be removably inserted into frame 22 and fire control housing insert 80. Magazine 23 is sized and configured for holding and dispensing a plurality of cartridges C.

Barrel 26 is movably disposed at least partially inside slide 24 and includes a front muzzle end 25 and rear breech end 27 that defines a rearwardly and forwardly open chamber 28 configured for receiving a cartridge C. An axial bore 31 extends between the muzzle and breech ends 25, 27 of the barrel 26 which forms a bullet pathway. Breech area 29 is defined at the rear of barrel 26 and chamber 28 24 for loading cartridges C therein from magazine 23. Slide 24 includes a breech block defining a forward facing breech face 30 which is axially moveable with the slide in relation to the chamber 28 to alternatingly form an open or closed breech in a manner well known in the art. Pistol 20 further includes a longitudinal axis LA defining an axial direction and which is approximately concentrically aligned with barrel 26 and slide 24 as shown in FIG. 1. Barrel 26 is moveable rearwards with slide 24 on firing control housing 80 under recoil after discharging pistol 20. Slide is movable rearwards on frame 22 under recoil or when manually cycling the action.

Figure 3:
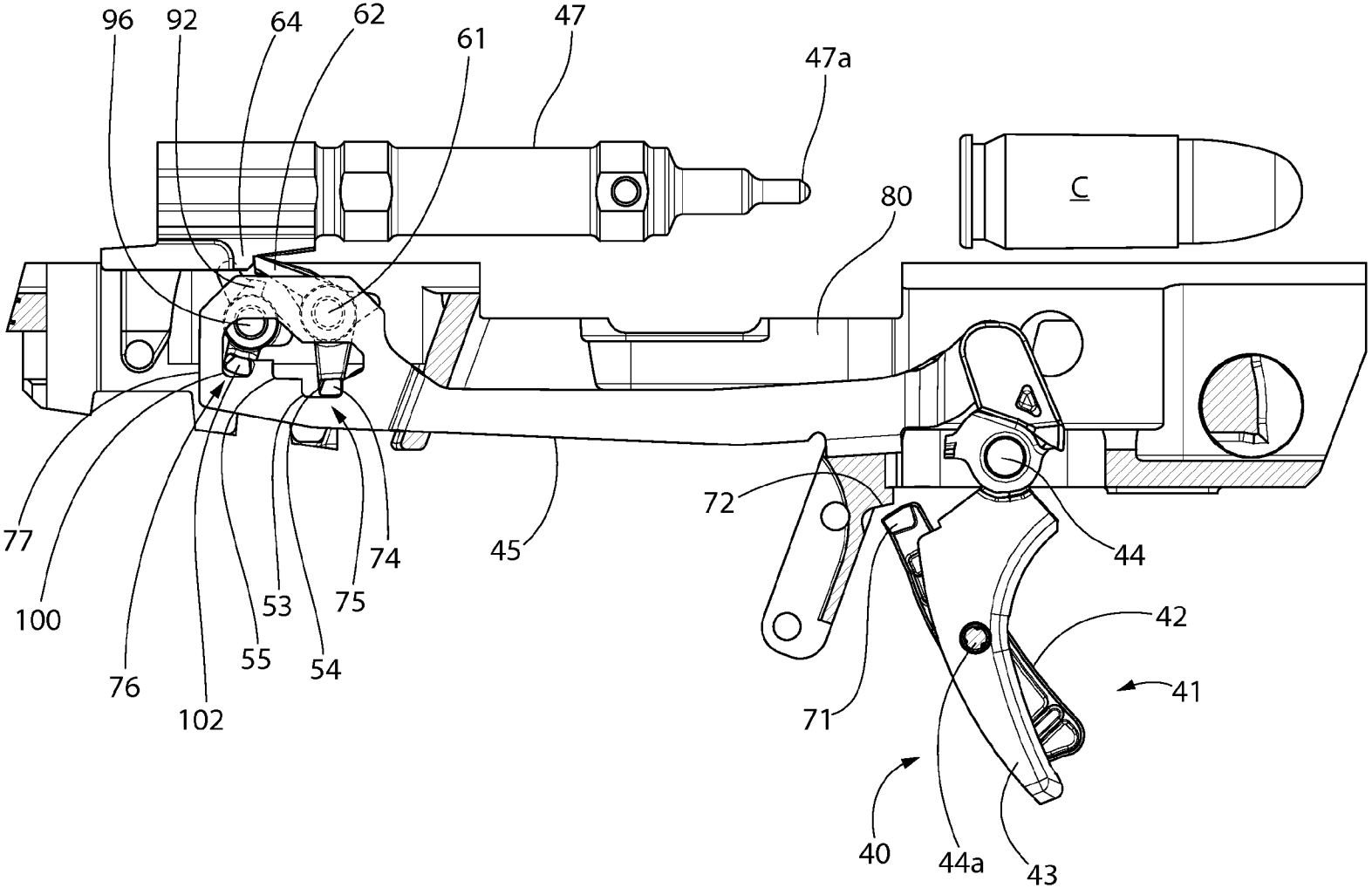
FIG. 3 is a right side elevation view of the fire control mechanism of FIG. 1 showing the striker in a cocked ready-to-fire position and engaged by the sear, and sear blocker positioned to engage the sear.
Figure 4:
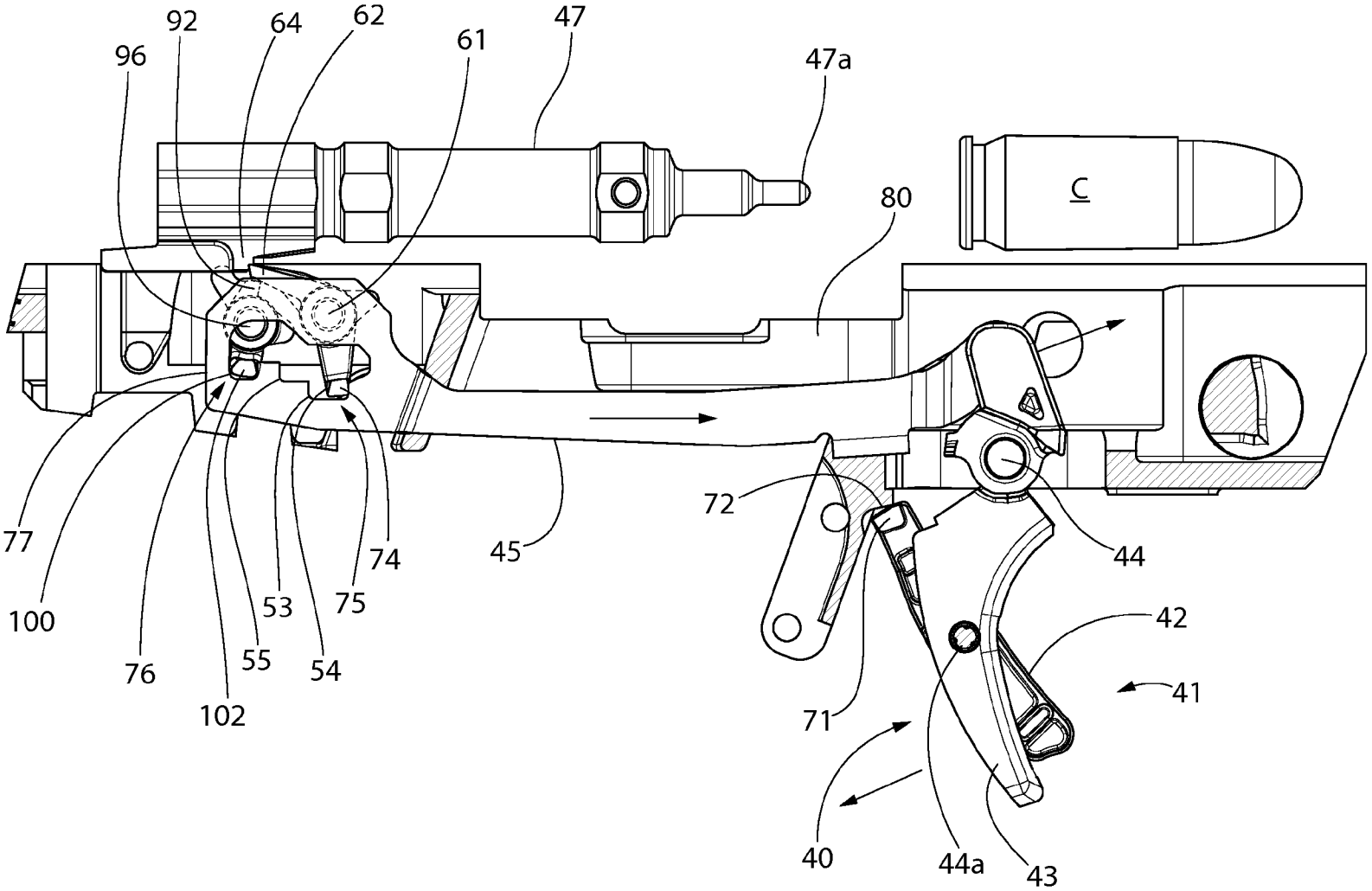
FIG. 4 is a right side elevation view of the fire control mechanism of FIG. 1 with the trigger partially pulled and showing the striker in a cocked ready-to-fire position and engaged by the sear, and sear blocker in a blocking position engaged with the sear.
Figure 5:
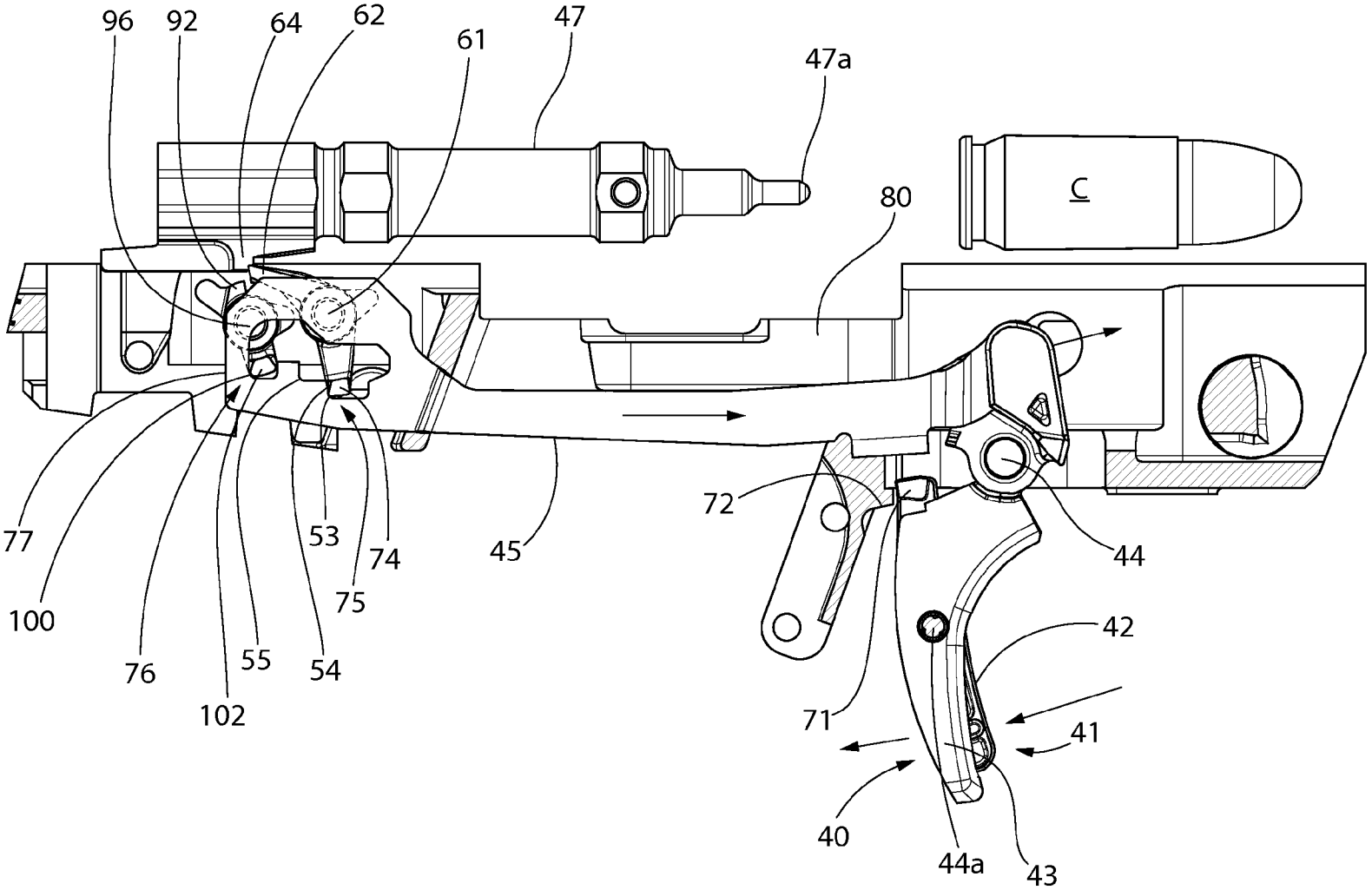
FIG. 5 is a right side elevation view of the fire control mechanism of FIG. 1 with the trigger further partially pulled and showing the striker in a cocked ready-to-fire position and engaged by the sear, and sear blocker in a non-blocking position disengaged from the sear.
Figure 6:
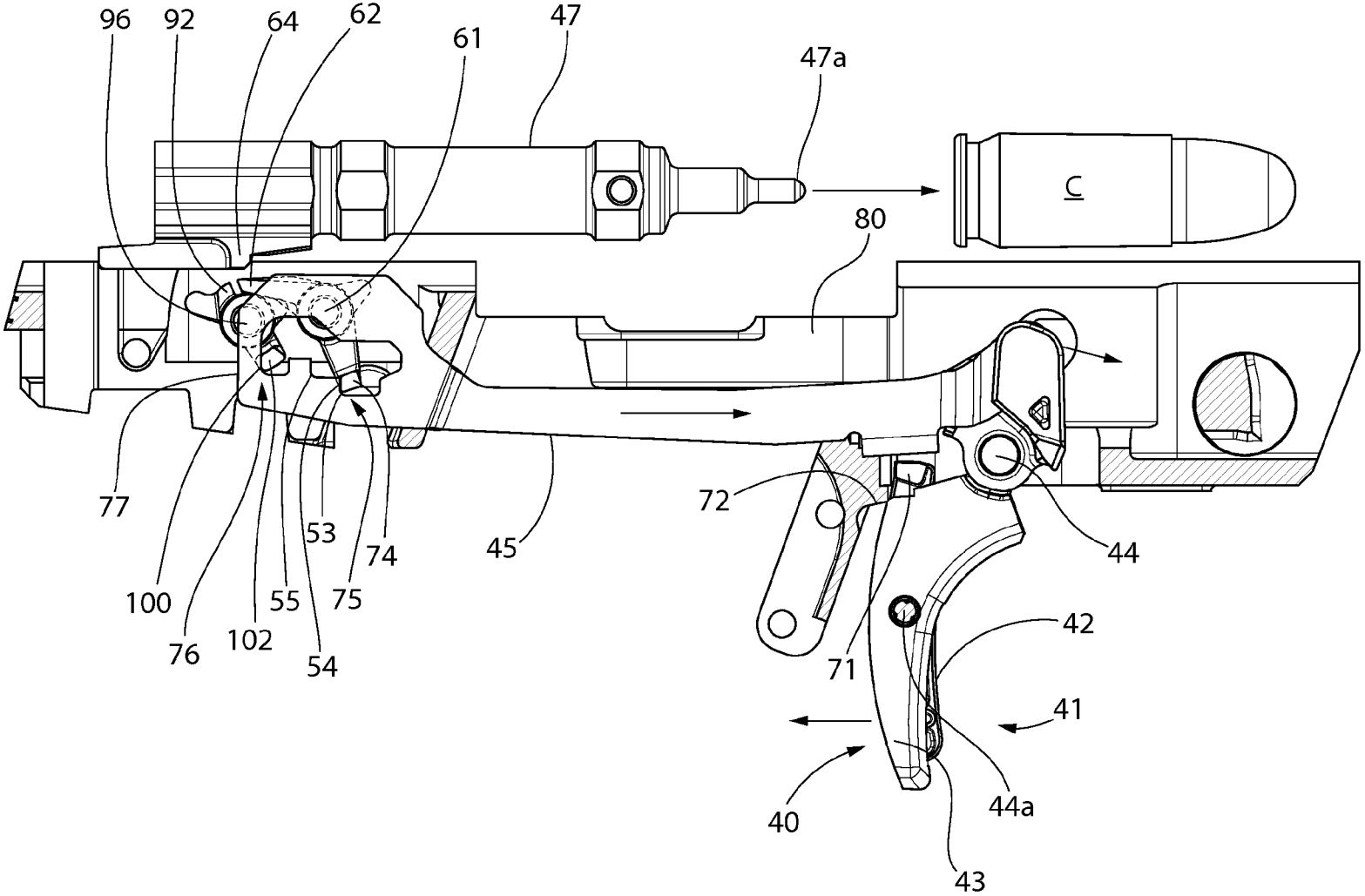
FIG. 6 is a right side elevation view of the fire control mechanism of FIG. 1 with the trigger fully pulled and showing the striker released by the sear to fire the firearm, and sear blocker in the non-blocking position.
Figure 7:
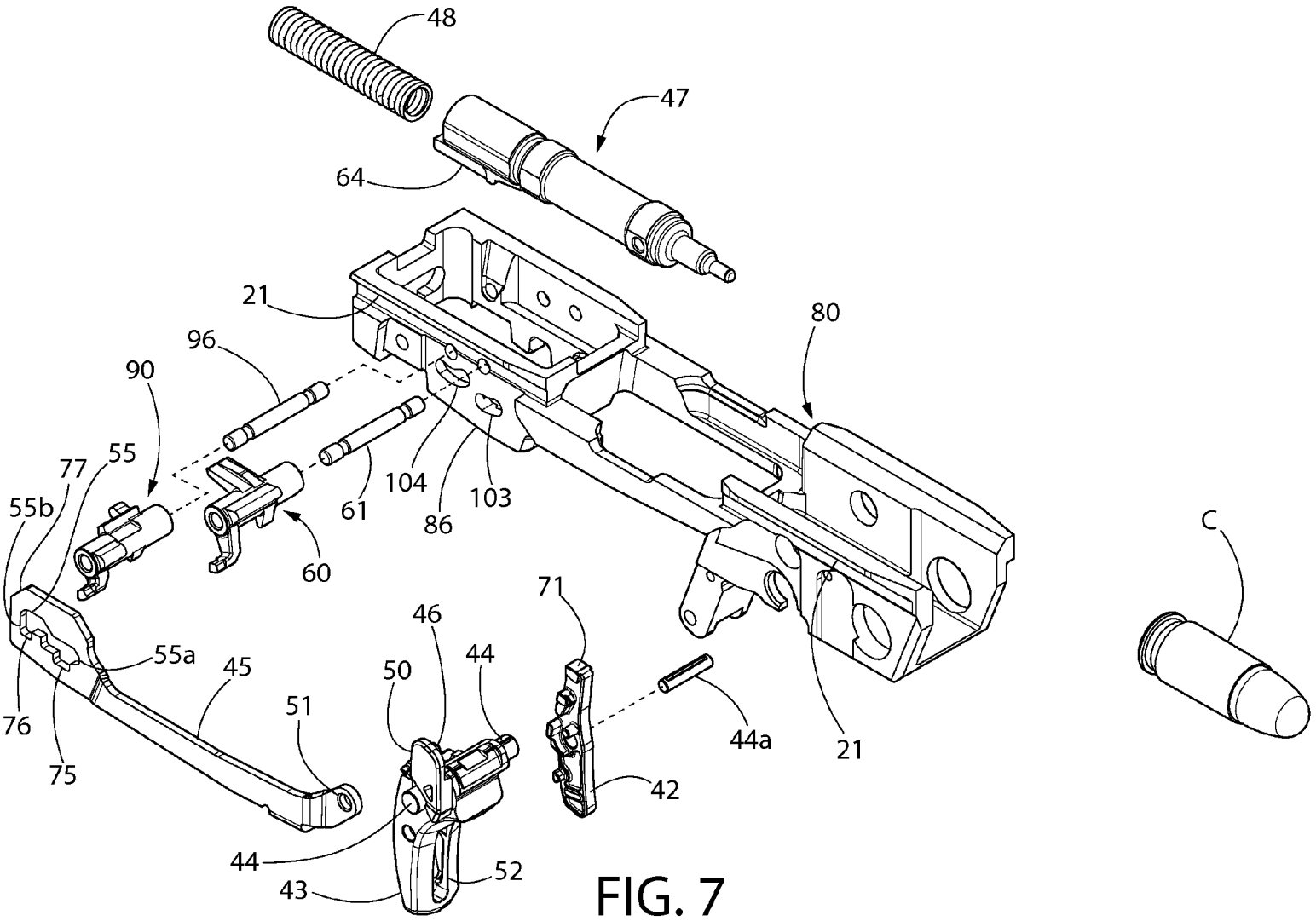
FIG. 7 is an exploded perspective view of fire control mechanism components and a fire control housing insert that supports the same.
Figure 8:
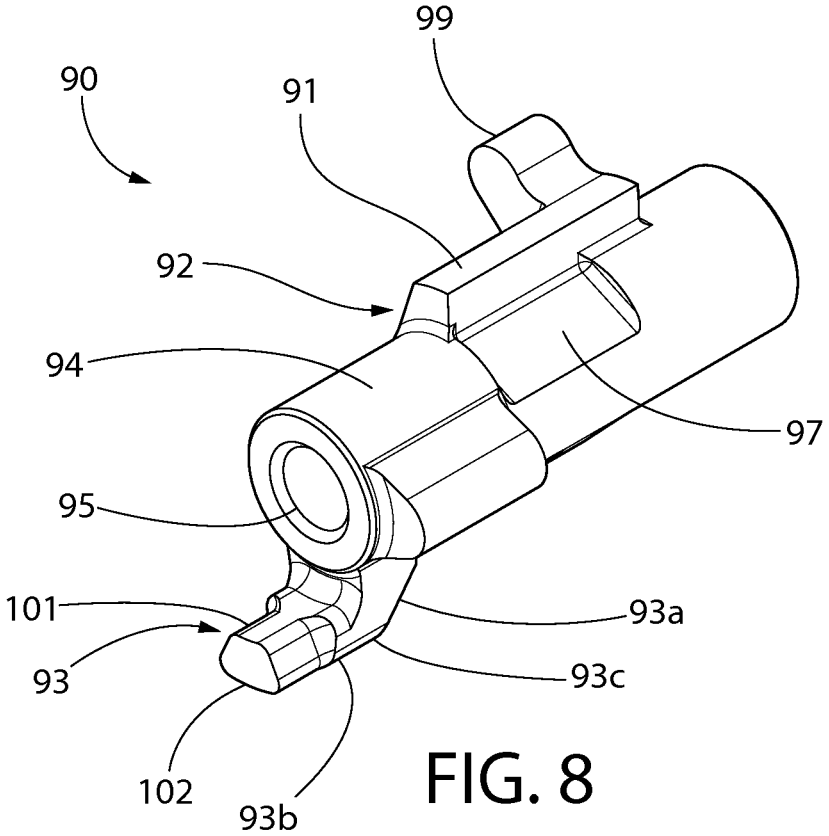
FIG. 8 is a perspective view of the sear blocker.

FIGS. 3-6 are right side elevation views of the fire control system and firing blocking mechanism alone disembodied from the supportive firearm frame 22 for clarity. The fire control system is shown in the firing sequence from a cocked ready-fire-position with the trigger not pulled in FIG. 3 through the fire position shown in FIG. 6. FIGS. 4 and 5 show intermediate operational positions of the fire control system during the firing sequence. FIG. 7 is an exploded view of the fire control system components. The fire control system components may be supported directly by the frame, or alternatively may be mounted in and supported by fire control housing insert 80 which is removably mountable in the frame as shown herein. Either construction may be used and numerous variations are possible.

Referring to FIGS. 3-7, the firing control system in one embodiment includes a trigger assembly 40 including a trigger 41 pivotally mounted in the insert 80 via a transverse pin 44, axially movable trigger bar 45 pivotally coupled to the trigger via a transverse pin 46 and hole 51 in the front of the trigger bar, and an axially linearly movable spring-biased striker 47 movably supported by slide 24 in an internal chamber 49 (see also FIG. 2) of the slide. In one embodiment, the trigger bar 45 is mounted to an upward projecting protrusion 50 on the trigger 41 that extends above the trigger transverse pin 44 and includes transverse trigger bar pin 46 formed thereon. The curved finger gripping portion of the trigger 41 extends below the trigger transverse pin. This arrangement causes the trigger bar 45 to be pulled axially forward when the finger gripping portion of the trigger is pulled and rotated rearward about transverse pin 44 which defines a pivot axis. Similarly, transverse pin 46 defines a pivot axis for the trigger bar 45.

The striker 47 may have a generally elongated cylindrical shape and is positioned to be released forward from a rearward cocked position (FIG. 3) by a trigger pull to strike and detonate a chambered cartridge disposed in the rear chamber 28 of the barrel 26. A striker spring 48 biases the striker 47 forward towards a chambered cartridge C for detonation. Spring 48 may be a helical compression spring in one embodiment and may be mounted at the rear of the striker (see, e.g. FIG. 7). Other type springs may be used. The front tip 47*a* of the striker 47 may be narrowed and configured to engage the rear end of the cartridge at the primer cap to detonate the ammunition.

Figure 10:
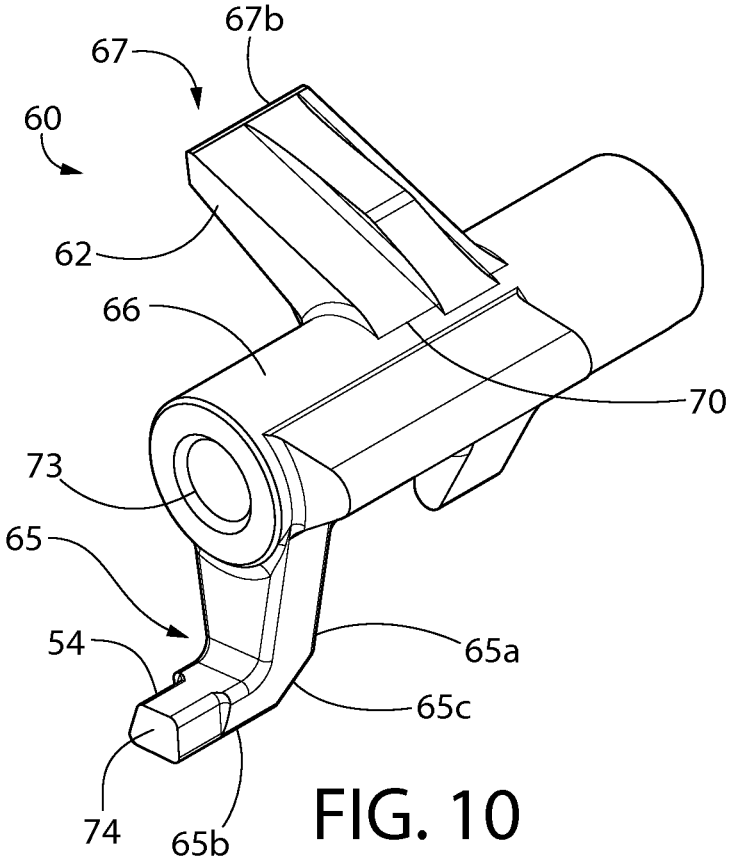
FIG. 10 is a perspective view of sear.

The striker 47 is captured in the cocked position and released by a rotatable sear 60 which may be mounted to the pistol via a transverse pin 61. The sear 60 is rotatably movable to selectively engage and disengage the striker. With additional reference now to FIGS. 10 and 11, the sear 60 includes an elongated operating arm 62 having a base end 70 connected to a hollow central cylindrical hub 66 defining a mounting hole 73 that receives transverse pin 61 and a free terminal end 67. Operating arm 62 extends upward and rearward from hub 66. The terminal end 67 of operating arm 62 selectively engages a striker sear notch 63 formed in the underside of the striker 47 on a lower downwardly extending operating or catch protrusion 64. The terminal end 67 may include a rear-facing flat surface 67*a* to positively engage the notch 63 which may have a similar flat surface configuration. The top edge 67*b* of the terminal free end 67 may engage a shoulder 68 formed by the notch 63 as shown for example in FIG. 3. An obliquely angled surface 69 may be formed below the notch to allow the operating arm 62 to smoothly disengage the notch when the trigger is fully pulled to release the striker 47.

The trigger bar 45 is configured to engage and actuate the sear 60 via a trigger pull to release the striker 47 for firing the pistol. The trigger bar 45 includes an actuating surface 53 which engages a corresponding actuated surface 54 disposed on the sear. In one embodiment, the trigger bar actuating surface 53 may be formed inside an longitudinally elongated transverse operating window 55 formed in a dimensionally enlarged rear end portion 77 of the trigger bar (in contrast to the middle and forward portions of the trigger bar which are vertically shorter in dimension). The sear actuated surface 54 may be formed in one embodiment on a lateral extension arm 65 that projects through the window 55 in the trigger bar 45 to engage the actuating surface 53 of the trigger bar. Extension arm 65 includes a base end attached to central hub 66 of the sear 60 and a free terminal end 74 configured and arranged to engage the operating window 55. The actuated surface 54 may be formed on the terminal end 74.

In one non-limiting exemplary embodiment, the lateral extension arm 65 may have a generally L-shape comprising a vertical section 65*a* extending downwards from a central hub 66, an elbow 65*c*, and a laterally extending horizontal section 65*b*. Actuated surface 54 may be at least partially flat and obliquely inclined in one embodiment. The sear 60 is rotatably movable from a ready-to-fire position engaged with the striker (FIG. 3) to a fire position disengaged from and releasing the striker (FIG. 6).

Figure 11:
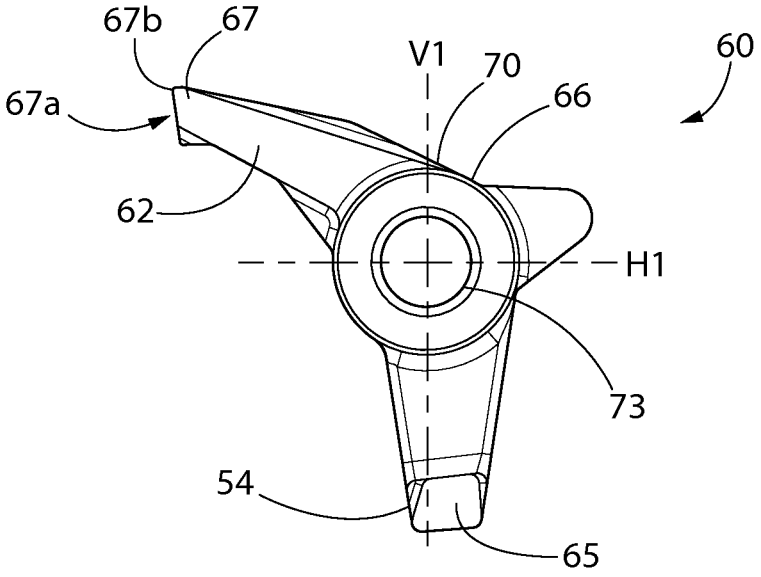
FIG. 11 is a right side elevation view thereof.
Figure 12:
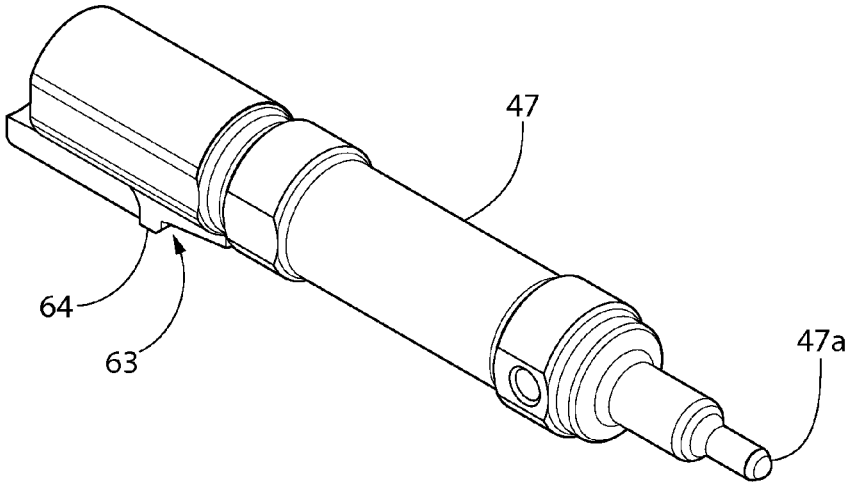
FIG. 12 is a perspective view of the striker.
Figure 13:
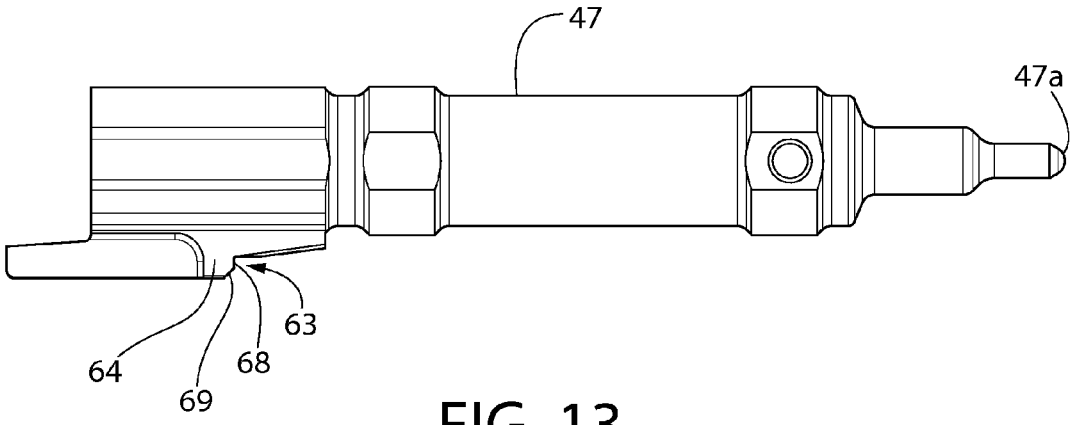
FIG. 13 is a right side elevation view thereof.

It will be appreciated that operating arm 62 extends upward and rearward from central hub 66 of the sear 60 towards the striker 47 at an angle between horizontal and vertical reference axes H1, V1 best shown in FIG. 11. Operating arm is oriented in an axial front to rear direction and positioned in the upper left (rear) quadrant of the sear 60 defined by axes H1, V1 and lateral extension arm 65 is positioned at least partially on the vertical reference axis V1 between the lower right (front) and left (rear) quadrants. Conversely, the sections 65*a* and 65*b* of the lateral extension arm 65 are each generally oriented in a transverse direction to the longitudinal axis LA and the axial direction.

Referring to FIGS. 3 and 7, the operating window 55 may be completely surrounded by the enlarged rear portion 77 of the trigger bar 45 as shown so that no portions of the window penetrate the outer peripheral top, bottom or side edges of the trigger bar. Operating window 55 includes a front end 55*a* and opposite rear end 55*b*. The window defines a front notch 75 proximate front end 55*a* and a rear notch 76 proximate rear end 55*b* and spaced axially apart from the front notch. The front and rear notches 75, 76 may be disposed and formed by a bottom surface of the operating window 55. In one embodiment, the front notch 75 may be positioned lower in the trigger bar 45 than the rear notch 76. In certain embodiments, the front notch 75 may further be axially longer than the rear notch 76. Front notch 75 defines actuating surface 53 and rear notch 76 defines actuating surface 100 for operating the sear 60 and sear blocker 90, respectively. The actuating surfaces 53, 100 may each comprise differently oriented segments such as a bottom horizontal segment and two opposing parallel vertical segments in certain embodiments which collectively form each operating surface.

Referring to FIGS. 3-9, the firing blocking mechanism may include a rotatable sear blocker 90 which is selectively engageable with the sear 60 to prevent moving the sear from the ready to fire position (see, e.g. FIG. 3) to the firing position (see, e.g. FIG. 6) in the absence of a trigger pull. The sear blocker 90 includes a blocking surface 91 which engages the sear to prevent rotation of the sear. This arrangement advantageously provides a first aspect of the firing blocking system and may help prevent inadvertent discharge of the firearm in the absence of an intentional trigger pull. The sear blocker 90 is rotatably movable to engage the sear in a first blocking position and disengage the sear in a second unblocking position, which in turn selectively engages or disengages the blocking surface 91 from the sear.

Figure 9:
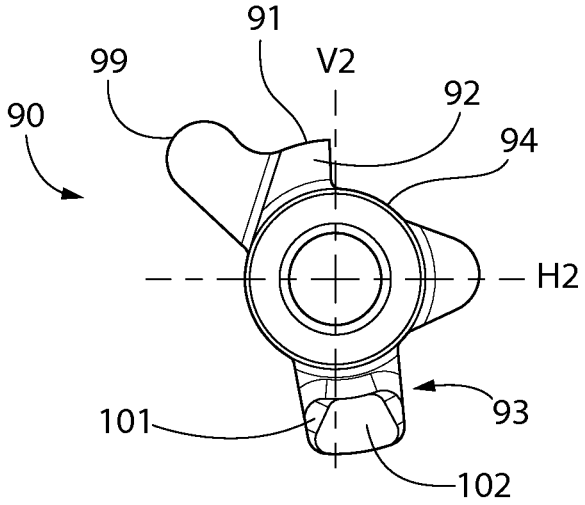
FIG. 9 is a right side elevation view (as mounted) thereof.

As shown in FIG. 9, the sear blocker 90 defines a horizontal reference axis H2 and vertical reference axis V2, and corresponding upper left and right quadrants and lower left and right quadrants similar to the sear.

With continuing reference to FIGS. 3-9, the sear blocker 90 includes a cylindrical central hub 94 that defines a mounting hole 95 for receiving a transverse pin 96 for rotatably mounting the blocker to the fire control housing insert 80. The blocker further includes an upright protrusion 92 which defines blocking surface 91 and a lateral extension arm 93 extending downwards from hub 94 and laterally. Arm 93 is configured to engage the trigger bar 45 for actuating and rotating the blocker via a trigger pull. Protrusion 92 may be formed on the top of blocker 90, and in one embodiment as shown may be located in the upper left (rear) quadrant. This positions the blocking surface 91 to selectively engage the underside of the operating arm 62 of the sear 60 to block rotation of the sear and release of the striker 47. The lateral extension arm 93 may be located between the lower right (front) and left (rear) quadrants as shown. In certain embodiments, the central hub 94 may further include a substantially flat portion defining a seating surface 97 for engaging and nesting the terminal end 67 of sear operating arm 62 thereon when the pistol is in the firing position (see, e.g. FIG. 6). The blocker 90 may further include an operating lobe 99 projecting rearwardly and upwards from hub 94. In one embodiment, the operating lobe 99 may be connected to the upright protrusion 92 on blocker 90 and may be located in the upper left (rear) quadrant as viewed in FIG. 9.

Figure 14:
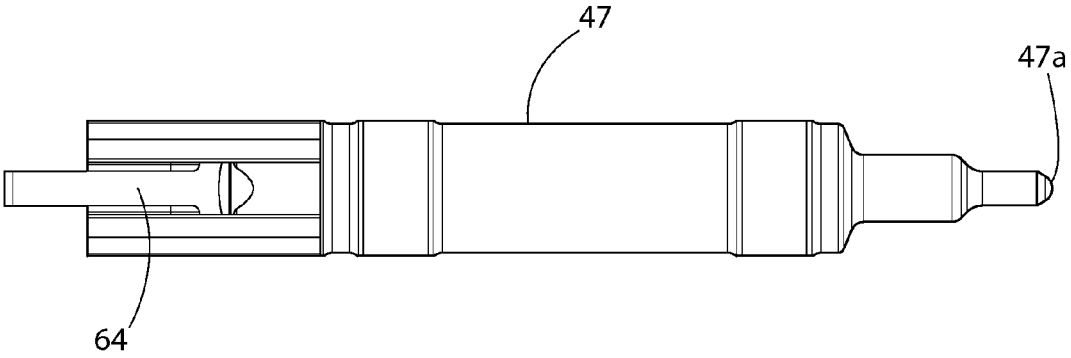
FIG. 14 is a bottom plan view thereof.
Figure 15:
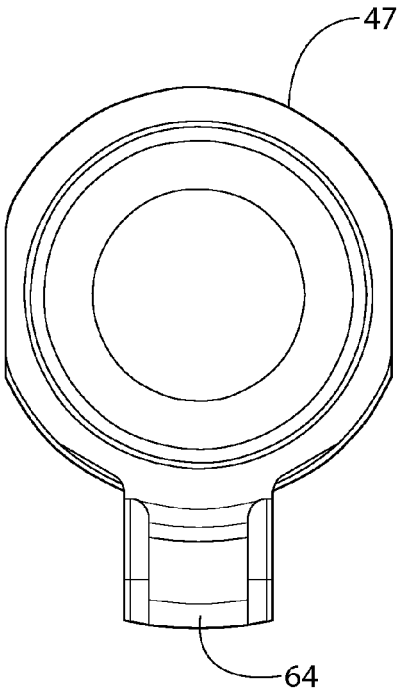
FIG. 15 is a rear end view thereof.
Figure 16:
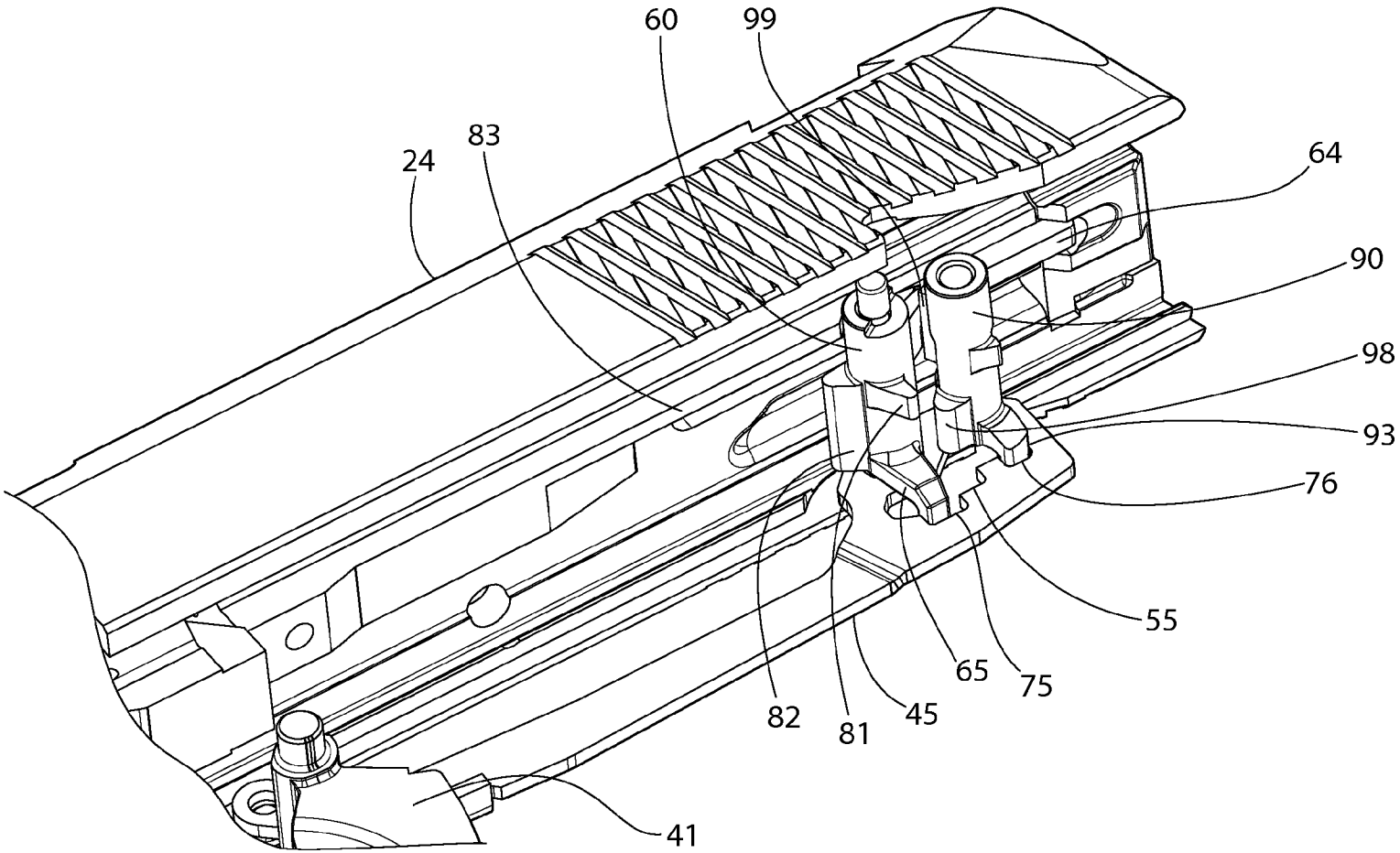
FIG. 16 is a bottom perspective view of the slide and fire control mechanism of FIG. 1.

Operating lobe 99 is operable and positioned to engage a bottom sliding surface 83 of the slide 24 (identified in FIGS. 2 and 16) for holding the sear blocker 90 in a downward position so that it is disengaged from the sear 60 while hand cycling the slide without the trigger 41 being pulled. Accordingly, blocker 90 may be rotated either by cycling the slide manually (i.e. sliding the slide rearward on frame 22 and returning it forward from a closed breech position) or via the trigger bar 45 by pulling the trigger 41. The lobe 99 is offset from the axial centerline of the striker 47 being more proximate to the left end of the blocker central hub 66. The catch protrusion 64 on striker 47 which is narrower than the cylindrical striker body (see, e.g. FIGS. 14 and 15) to allow the lobe 99 to engage the sliding surface 83 on the slide 24. The lobe 99 is positioned along the lateral left side of the catch protrusion 64 as shown by the dotted line portion in FIG. 3 when blocker 90 is in the blocking position. The terminal end of operating lobe 99 may be rounded in shape to smoothly engage the sliding surface 83.

It should be noted that all references herein to the quadrants defined by vertical reference axes V1, V2 and horizontal reference axes H1, H2 are from the perspective of the right side views in FIGS. 9 and 11 showing the "as mounted" orientation of the sear 60 and blocker 90 as seen from the right side of the pistol 20 in FIG. 2.

With continuing reference now to FIGS. 3-9, the trigger bar 45 is further configured by operating window 55 to engage and rotate the sear blocker 90 between the blocking and non-blocking positions via a trigger pull to release and permit rotation of the sear 60 by a sufficient extent to release the striker from the cocked position for firing the firearm. The trigger bar 45 includes a second actuating surface 100 which engages a corresponding second actuated surface 101 disposed on the sear blocker 90. In one embodiment, the second actuating surface 100 may be formed inside the same or a second discrete transverse window formed in the dimensionally enlarged rear end portion of the trigger bar. The illustrated embodiment herein shows actuating surface 100 formed in the same single large operating window 55. The sear blocker actuated surface 101 may be formed in one embodiment on a lateral extension arm 93 having a free terminal end 102 that projects into the window 55 in the trigger bar to engage rear notch 76. In one embodiment, the sear 60 and sear blocker 90 rotate in the same rotational direction when actuated by the trigger bar. The sear 60 and sear blocker 90 preferably may be mounted on separate transverse pins 61, 96 respectively which are spaced longitudinally apart and form parallel rotational axes.

In one non-limiting exemplary embodiment, the lateral extension arm 93 may be configured similarly to sear extension arm 65 and similarly is L-shaped including a base end attached to central hub 94 of the blocker 90 and extending downwards therefrom and a free terminal end 102 extending laterally which is configured and arranged to engage the operating window 55. The actuated surface 101 may be formed on the terminal end 102. Lateral extension arm 93 may also have a generally L-shape comprising a vertical section 93*a* extending downwards from central hub 94, an elbow 93*c*, and a laterally extending horizontal section 93*b*. Actuated surface 101 on blocker 90 may be at least partially flat and obliquely inclined in one embodiment. The sear blocker 90 is rotatably movable from a blocking position engaged with sear 60 (FIG. 4) to a non-blocking position (FIGS. 5-6) disengaged from the sear 60 to release the striker.

In order to provide access to the trigger bar 45 for the terminal ends 74, 102 of lateral extension arms 65 and 93 on the sear 60 and sear blocker 90 respectively, a pair of arcuately shaped through-slots 103, 104 may be provided on the lateral side 86 of fire control housing insert 80 adjacent the trigger bar 45. The sear and blocker and their respective lateral extension arms mounted inside the insert 80 may now engage the notches 75 and 76 in the trigger bar to form an operable linkage. It will be appreciated that other arrangements are possible.

Referring now to FIGS. 3-7, the trigger 41 of the trigger assembly 40 may be a multi-component member including an outer primary or main trigger 43 and a secondary or inner safety trigger 42 mounted to main trigger 43 and pivotable about transverse pin 44*a*. Safety trigger 42 is therefore pivotable and movable in relation to main trigger 43. The safety trigger 42 may be pivotably mounted to and disposed in an elongated vertical slot 52 in the main trigger. The safety trigger 42 further includes an upward projecting blocking protrusion 71 which is configured and arranged to selectively engage a stopping surface 72 disposed in the firearm frame. In one embodiment, stopping surface 72 may be formed on fire control housing insert 80. When the main trigger 43 alone is pulled (see, e.g. FIGS. 3 and 4, the blocking protrusion 71 engages the stopping surface 72 which arrests and prevents full movement of the trigger mechanism to the extent necessary to release the striker. When the user also depresses the inner safety trigger 42, the blocking protrusion 71 rotates forward and out of engagement with the stopping surface 72 to then allow a full trigger pull for discharging the firearm (see, e.g. FIGS. 5 and 6). This arrangement provides a second aspect of the firing blocking system and advantageously may help prevent inadvertent discharge of the firearm in the absence of an intentional trigger pull.

FIGS. 3-6 show the operation and movement of the fire control system and firing blocking mechanism components in sequential steps of discharging the firearm. The directional arrows in these figures show the movement of the trigger assembly and striker.

FIG. 3 shows the fire control system in a cocked (i.e. striker 47) ready-to-fire position. The operating arm 62 of sear 60 is engaged with the sear notch 63 of the striker 47 which prevent release of the striker. The trigger 41 (inner safety trigger 42 and outer main trigger 43) are not actuated by the user at this juncture. The sear blocker 90 is rotated and biased into the blocking position by a blocker spring (not shown for clarity). The blocking surface 91 on the sear blocker 90 is positioned beneath and slightly spaced apart from or contacting the underside of the sear operating arm 62 to prevent movement of sear 60 sufficient to release the striker.

FIG. 4 shows the sear 60 movement blocked by the sear blocker 90 and trigger movement blocked by the undepressed inner safety trigger 42. The trigger 41 is pulled to the point where the inner safety trigger 42 rotation is stopped by the stopping surface 72 on fire control housing insert 80 and cannot be pulled any further without manually depressing the safety trigger. Blocking both movement of the sear and trigger function together to help prevent discharge of the pistol. The operating arm 62 of sear 60 is still engaged with sear notch 63 on striker 47.

FIG. 5 shows the sear 60 movement unblocked by the sear blocker 90 and trigger 41 movement unblocked by a depressed inner safety trigger 42. The safety trigger 42 is depressed which allows the main trigger 42 and safety trigger to be pulled. The safety trigger is removed from engagement with the stopping surface 72 in the frame 22 which allows the trigger 41 to be pulled more fully. The trigger pull in turn initially rotates the blocker 90 (counter-clockwise) to the non-blocking position shown via the trigger bar 45 and rear notch 76-lateral extension arm 93 interface wherein the blocking surface 91 is no longer positioned beneath and engaged with the operating arm 62 of sear 60. The operating arm 62 of the sear 60 is still engaged with the sear notch 63 on the striker 47 but now free to rotate downwards out of engagement with the striker by further pulling the trigger.

FIG. 6 shows the firearm in a fire or firing position with the striker 47 being rotated counter-clockwise and released via a full trigger pull unimpeded by the sear blocker 90 and inner safety trigger 42. The top edge 67*b* of the terminal free end 67 of the sear operating arm 62 fully disengages sear notch 63 via the trigger bar 45 and front notch 75—lateral extension arm 65 interface. This releases the striker 47 forward to striker and detonate a chambered cartridge C under the biasing force of striker spring 48.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with striker firing mechanism comprising:

a longitudinal axis;

a frame;

a reciprocating slide disposed on the frame;

a barrel disposed at least partially in the slide and defining a chamber for holding a cartridge;

a spring-biased striker movable in a linear path between a rearward cocked position and forward firing position for striking a chambered cartridge, the striker including a catch protrusion;

a trigger mechanism including a trigger bar coupled to a trigger movably disposed in the frame, the trigger bar movable in rearward and forward axial directions via operation of the trigger;

a sear rotatably disposed in the frame and operably linked to the trigger bar, the sear movable via operation of the trigger to selectively engage the catch protrusion to hold the striker in the rearward cocked position and to disengage the catch protrusion to release the striker for striking the chambered cartridge; and a blocker rotatably disposed in the frame and operably linked to the trigger bar, the blocker movable into and out of engagement with the sear via operation of the trigger;

wherein the blocker is rotatable between a blocking position engaged with the sear which prevents movement of the sear to release the striker from the rearward cocked position and a non-blocking position disengaged from the sear which is then movable to release the striker for firing the firearm;

wherein the trigger bar is configured so that pulling the trigger moves both the sear and the blocker; and wherein the sear and blocker are mounted about separate parallel pivot axes.

2. The firearm according to claim 1, wherein the blocker has a pivot axis that is positioned rearward of a pivot axis of the sear.

3. A firearm with striker firing mechanism comprising:

a longitudinal axis;

a frame;

a reciprocating slide disposed on the frame;

a barrel disposed at least partially in the slide and defining a chamber for holding a cartridge;

a spring-biased striker movable in a linear path between a rearward cocked position and forward firing position for striking a chambered cartridge, the striker including a catch protrusion;

a trigger mechanism including a trigger bar coupled to a trigger movably disposed in the frame, the trigger bar movable in rearward and forward axial directions via operation of the trigger;

a sear rotatably disposed in the frame and operably linked to the trigger bar, the sear movable via operation of the trigger to selectively engage the catch protrusion to hold the striker in the rearward cocked position and to disengage the catch protrusion to release the striker for striking the chambered cartridge; and a blocker rotatably disposed in the frame and operably linked to the trigger bar, the blocker movable into and out of engagement with the sear via operation of the trigger;

wherein the blocker is rotatable between a blocking position engaged with the sear which prevents movement of the sear to release the striker from the rearward cocked position and a non-blocking position disengaged from the sear which is then movable to release the striker for firing the firearm;

wherein the sear includes an elongated operating arm which is selectively engageable with the catch protrusion of the striker;

wherein the blocker has a blocking surface which is selectively movable to engage or disengage the operating arm of the sear.

4. The firearm according to claim 3, wherein the blocking surface engages the underside of the operating arm of the sear when the blocker is in the blocking position to prevent movement of the sear.

5. The firearm according to claim 3, wherein the operating arm of the sear is cleared of the blocker to rotate when the blocker is in the non-blocking position and the striker moves to the firing position.

6. A firearm with striker firing mechanism comprising:

a longitudinal axis;

a frame;

a reciprocating slide disposed on the frame;

a barrel disposed at least partially in the slide and defining a chamber for holding a cartridge;

a spring-biased striker movable in a linear path between a rearward cocked position and forward firing position for striking a chambered cartridge, the striker including a catch protrusion;

a trigger mechanism including a trigger bar coupled to a trigger movably disposed in the frame, the trigger bar movable in rearward and forward axial directions via operation of the trigger;

a sear rotatably disposed in the frame and operably linked to the trigger bar, the sear movable via operation of the trigger to selectively engage the catch protrusion to hold the striker in the rearward cocked position and to disengage the catch protrusion to release the striker for striking the chambered cartridge; and a blocker rotatably disposed in the frame and operably linked to the trigger bar, the blocker movable into and out of engagement with the sear via operation of the trigger;

wherein the blocker is rotatable between a blocking position engaged with the sear which prevents movement of the sear to release the striker from the rearward cocked position and a non-blocking position disengaged from the sear which is then movable to release the striker for firing the firearm;

wherein the blocker and the sear each have a lateral extension arm that engages a respective notch defined by a window formed in the trigger bar for actuating the blocker and sear via a trigger pull.

7. The firearm according to claim 6, wherein the lateral extension arms each have an L-shape.

8. The firearm according to claim 1, wherein the blocker has a cylindrical hub mounted about a transverse pin in the frame which defines a pivot axis for the blocker.

9. A pistol with striker firing mechanism comprising:

a longitudinal axis;

a frame;

a reciprocating slide disposed on the frame;

a barrel disposed at least partially in the slide and defining a chamber for holding a cartridge;

a spring-biased striker movable in a linear path between a rearward cocked position and forward firing position for striking a chambered cartridge, the striker including a sear notch;

a trigger assembly including a trigger bar coupled to a trigger movably disposed in the frame, the trigger bar movable in rearward and forward axial directions via operation of the trigger;

a sear rotatably disposed in the frame and operably linked to the trigger bar, the sear movable via operation of the trigger to selectively engage the sear notch to hold the striker in the rearward cocked position and to disengage the sear notch to release the striker for striking the chambered cartridge; and a blocker rotatably disposed in the frame and operably linked to the trigger bar, the blocker having a blocking surface movable into and out of engagement with the sear via operation of the trigger;

wherein the blocker is movable to a first rotational blocking position that arrests movement of the sear and a second rotational non-blocking position that enables rotation of the sear to fire the pistol;

wherein the blocking surface of the blocker is selectively engageable with an operating arm extending outwards from the sear that is engageable with the sear notch of the striker.

10. The pistol according to claim 9, wherein the operating arm extends upward and rearward from a central cylindrical hub of the sear mounted about a transverse pin that defines a rotational sear axis.

11. The pistol according to claim 10, wherein the blocking surface is formed on an upright protrusion of the blocker and is selectively engageable with the operating arm to block movement of the sear.

12. The pistol according to claim 9, wherein the trigger includes an inner safety trigger and an outer main trigger, the safety trigger including an upward projecting blocking protrusion which is configured and arranged to selectively engage a stopping surface disposed in the frame.

13. A pistol with striker firing mechanism comprising:

a longitudinal axis;

a frame;

a reciprocating slide disposed on the frame;

a barrel disposed at least partially in the slide and defining a chamber for holding a cartridge;

a spring-biased striker movable in a linear path between a rearward cocked position and forward firing position for striking a chambered cartridge, the striker including a sear notch;

a trigger assembly including a trigger bar coupled to a trigger movably disposed in the frame, the trigger bar movable in rearward and forward axial directions via operation of the trigger;

a sear rotatably disposed in the frame and operably linked to the trigger bar, the sear movable via operation of the trigger to selectively engage the sear notch to hold the striker in the rearward cocked position and to disengage the sear notch to release the striker for striking the chambered cartridge; and a blocker rotatably disposed in the frame and operably linked to the trigger bar, the blocker having a blocking surface movable into and out of engagement with the sear via operation of the trigger;

wherein the blocker is movable to a first rotational blocking position that arrests movement of the sear and a second rotational non-blocking position that enables rotation of the sear to fire the pistol;

wherein the trigger bar includes a first notch and a second notch, the first notch engaged with the sear and the second notch engaged with the blocker such that pulling the trigger rotates the sear and blocker.

14. The pistol according to claim 13, wherein the sear includes a first lateral extension arm engaged with the first notch and the blocker includes a second lateral extension arm engaged with the second notch.

15. The pistol according to claim 14, wherein at least one of the first or second lateral arms is L-shaped.

16. The pistol according to claim 14, wherein the first and second extension arms extend through a respective curved through-slot formed in a fire control housing insert which supports the trigger assembly, the sear and block being supported by the insert.

17. A method for firing the pistol according to claim 9, the method comprising:

engaging the sear with the sear notch of the striker to hold the sear in the rearward cocked position;

positioning the blocker in the blocking position;

pulling the trigger;

rotating the blocker to the non-blocking position;

rotating the sear to disengage the sear from the sear notch; and moving the striker to the forward firing position to discharge the pistol.

18. The method according to claim 17, further comprising engaging the trigger bar with the sear and the blocker, wherein the step of pulling the trigger moves the trigger bar axially forward to rotate the sear and sear blocker.

19. A firearm with striker firing mechanism comprising:

a longitudinal axis;

a frame;

a reciprocating slide disposed on the frame;

a barrel disposed at least partially in the slide and defining a chamber for holding a cartridge;

a spring-biased striker movable in a linear path between a rearward cocked position and forward firing position for striking a chambered cartridge, the striker including a sear notch;

a trigger assembly including a trigger bar coupled to a trigger movably disposed in the frame, the trigger bar movable in rearward and forward axial directions via operation of the trigger;

a sear rotatably disposed in the frame and operably linked to a first notch in the trigger bar, the sear engaged with the striker and movable via operation of the trigger to disengage and release the striker for movement to the firing position; and a blocker rotatably disposed in the frame and operably linked to a second notch in the trigger bar, the blocker having a blocking surface movable into and out of engagement with the sear via operation of the trigger;

wherein the blocker is movable to a first rotational blocking position that arrests movement of the sear and a second rotational non-blocking position that enables rotation of the sear to fire the pistol.

20. The firearm according to claim 19, wherein the first and second notches are defined by an operating window formed in an enlarged rear portion of the trigger bar.

* * * * *